US008225426B2

(12) United States Patent
Bevier

(10) Patent No.: US 8,225,426 B2
(45) **Date of Patent: *Jul. 24, 2012**

(54) GLOVE WITH GRIPPING SURFACE

(75) Inventor: Joseph J. Bevier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 855 days.

This patent is subject to a terminal disclaimer.

(21) Appl. No.: 11/948,706

(22) Filed: Nov. 30, 2007

(65) Prior Publication Data

US 2009/0139007 A1 Jun. 4, 2009

(51) Int. Cl.
*A41D 19/00* (2006.01)

(52) U.S. Cl. ..... 2/161.6

(58) Field of Classification Search ..... 2/161.6–161.8, 2/168, 169

See application file for complete search history.

(56) References Cited

U.S. PATENT DOCUMENTS

| | | | | |
|---|---|---|---|---|
| 1,979,130 | A * | 10/1934 | Wiley | 2/168 |
| 3,404,409 | A | 10/1968 | Tillotson, et al. | |
| 4,689,832 | A | 9/1987 | Mulvaney | |
| 4,881,276 | A * | 11/1989 | Swan | 2/161.1 |
| 5,117,509 | A | 6/1992 | Bowers | |
| 5,423,089 | A | 6/1995 | Chun et al. | |
| 5,500,956 | A | 3/1996 | Schulkin et al. | |
| 5,511,248 | A | 4/1996 | Widdemer | |
| 5,598,582 | A | 2/1997 | Andrews et al. | |
| 5,625,900 | A | 5/1997 | Hayes | |
| 5,774,895 | A | 7/1998 | Baldwin | |
| 5,956,772 | A | 9/1999 | Widdemer | |
| 6,044,494 | A | 4/2000 | Kang | |
| 6,065,155 | A | 5/2000 | Sandusky | |
| 6,092,238 | A | 7/2000 | Fierabend, Jr. | |
| 6,099,936 | A | 8/2000 | Kashihara | |
| 6,209,138 | B1 | 4/2001 | Kang | |
| 6,408,442 | B1 | 6/2002 | Kang | |
| D494,713 | S | 8/2004 | Wheelington, II | |
| 6,912,731 | B2 | 7/2005 | Cass | |
| 6,928,658 | B2 | 8/2005 | Taira et al. | |
| D549,397 | S | 8/2007 | VanErmen | |
| 7,310,826 | B2 | 12/2007 | Kishihara | |
| 2003/0000005 | A1 | 1/2003 | Faulconer | |
| 2004/0025226 | A1 * | 2/2004 | Jaeger | 2/161.6 |
| 2006/0041991 | A1 | 3/2006 | Kim Sim | |
| 2006/0048268 | A1 | 3/2006 | Loos | |
| 2006/0168706 | A1 | 8/2006 | Auger et al. | |
| 2009/0139010 | A1 * | 6/2009 | Bevier | 2/161.8 |
| 2010/0192280 | A1 | 8/2010 | Mcclard et al. | |

OTHER PUBLICATIONS

Non-Final Office Action issued in related U.S. Appl. No. 12/043,817, mailed Mar. 29, 2011.

* cited by examiner

*Primary Examiner* — Katherine Moran
(74) *Attorney, Agent, or Firm* — Banner & Witcoff, Ltd.

(57) ABSTRACT

A glove with a base layer of a flexible material which extends along at least a palm-side portion of the glove which includes a palm area and inner sides of a plurality of finger stalls and a thumb stall. The glove also has a second layer positioned on the palm-side portion and disposed on top of the base layer. The second layer includes a plurality of contact areas and a contact surface. Also, the glove has a plurality of siping grooves which conduct liquid away from the contact surface and a plurality of channels which direct liquid away from the contact areas.

20 Claims, 9 Drawing Sheets

GLOVE WITH GRIPPING SURFACE

FIELD OF THE DISCLOSURE

Aspects of the present disclosure generally relate to apparel such as gloves, and more particularly to gloves that include an improved gripping surface even in wet conditions.

BACKGROUND

Gloves are worn for a variety of reasons. One such reason is that gloves may provide additional grip for handling an object. Such additional grip may be desirable in athletic activities. For example, in soccer a goal-keeper may wear gloves to provide additional grip when handling the soccer ball. Another example, involves a receiver in football who may wear gloves to provide additional grip when catching the football. Some conventional gloves have surfaces on the palm area and finger stalls that improve the friction, or grip, of the glove. For example, in these gloves the palm area and finger stalls may include tackified surfaces (See e.g. U.S. Pat. No. 4,689,832 to Mulvaney) or surfaces with Polyvinyl Chloride (PVC) (See e.g. U.S. Pat. No. 6,065,155 to Sandusky) to increase the gripping ability. However, wet conditions may affect the gripping ability of such gloves. For example, such gloves may be worn during athletic activities that take place outside. Exposure to the elements such as precipitation (e.g. rain, sleet, snow, etc.) may reduce the friction or gripping ability of glove. Precipitation will stay on the palm and finger surfaces of the glove and act as a lubricant. Therefore, the palm surface becomes slick and gripping ability is diminished. Some conventional gloves have attempted to overcome the effects that moisture has on a glove's gripping ability. For example, U.S. Pat. No. 6,044,494 to Kang, "Athletic Glove having Silicone-Printed Surface for Consistent Gripping Ability in Various Moisture Conditions" discloses a glove with a silicone sealant penetrated into the fibers of the glove so the glove retains a surface that is substantially level. In such gloves silicone is typically applied to the glove's palm with a screen printing process which is essentially a "two-dimensional" application of resin, plastic or rubber to the surface of the flat palm material in order to keep the surface substantially level. This flat surface creates a boundary layer that allows water to bead up or create a film which causes objects that the surface comes into contact with to slip or skid off (much like car tires hydroplaning on a wet road). Therefore, there exists a need for a glove that can provide improved gripping ability to the wearer even in wet conditions.

SUMMARY

The present disclosure generally relates to new and novel structures for apparel such as gloves that provide improved gripping ability even in wet conditions. While the gloves may be referenced in regard to athletic activities, such reference is not meant to be limiting. Instead, the gloves may be used for any purpose in which it would be desirable to have increased gripping ability and especially in wet conditions that may affect a glove's gripping characteristics.

Aspects of this disclosure relate to a glove which provides improved gripping abilities through features on a palm-side portion of the glove. These features increase the gripping ability of the glove and remove liquid (e.g. water) away from a palm-side portion of the glove so that the glove retains its improved gripping ability even when the glove is used in wet conditions such as rain or other precipitation.

One aspect of this disclosure relates to a glove with a base layer of a flexible material which extends along at least a palm-side portion of the glove which includes a palm area and inner sides of a plurality of finger stalls and a thumb stall. The glove also may include a second layer positioned on the palm-side portion and disposed on top of the base layer. The second layer includes a plurality of contact areas and a contact surface. Also, the glove may have a plurality of siping grooves which conduct liquid away from the contact surface and a plurality of channels which direct liquid away from the contact areas.

Additional aspects of this disclosure relate to the siping grooves which are disposed in the second layer and a capillary action of the siping grooves which draws liquid off the contact surface of the second layer and conducts the liquid into the depth of the siping grooves.

In additional aspects of the disclosure, the contact areas of the second layer are raised and each contact area varies in thickness across its respective area. The contact surface is the top of the raised contact areas and the second layer is disposed on the base layer in a discontinuous manner so as to define the plurality of channels between the raised contact areas.

The above summary presents general aspects of the disclosure in order to provide a basic understanding of at least some of its aspects. The summary is not intended as an extensive overview of the disclosure. It is not intended to identify key or critical elements of the disclosure or to delineate the scope of the disclosure. The above summary merely presents some concepts of the disclosure in a general form as a prelude to the more detailed description provided below.

BRIEF DESCRIPTION OF THE DRAWINGS

A more complete understanding of the present disclosure and certain advantages thereof may be acquired by referring to the following description in consideration with the accompanying drawings, in which like reference numbers indicate like features, and wherein.

DETAILED DESCRIPTION

In the following description of various example embodiments of the disclosure, reference is made to the accompanying drawings, which form a part hereof, and in which are shown by way of illustration various example structures and systems in which aspects of the disclosure may be practiced. It is to be understood that other specific arrangements of parts, structures, example devices, systems, and the like may be utilized and structural and functional modifications may be made without departing from the scope of the present disclosure. Also, while the terms "top," "bottom," "front," "back," "side," and the like may be used in this specification to describe various example features and elements of the disclosure, these terms are used herein as a matter of convenience, e.g. based on the example orientations shown in the figures and/or orientations during typical use (for example, when viewing a glove as worn on a user's hand). Nothing in this specification should be construed as requiring a specific three dimensional orientation of structures in order to fall within the scope of this disclosure.

Figure 1A:
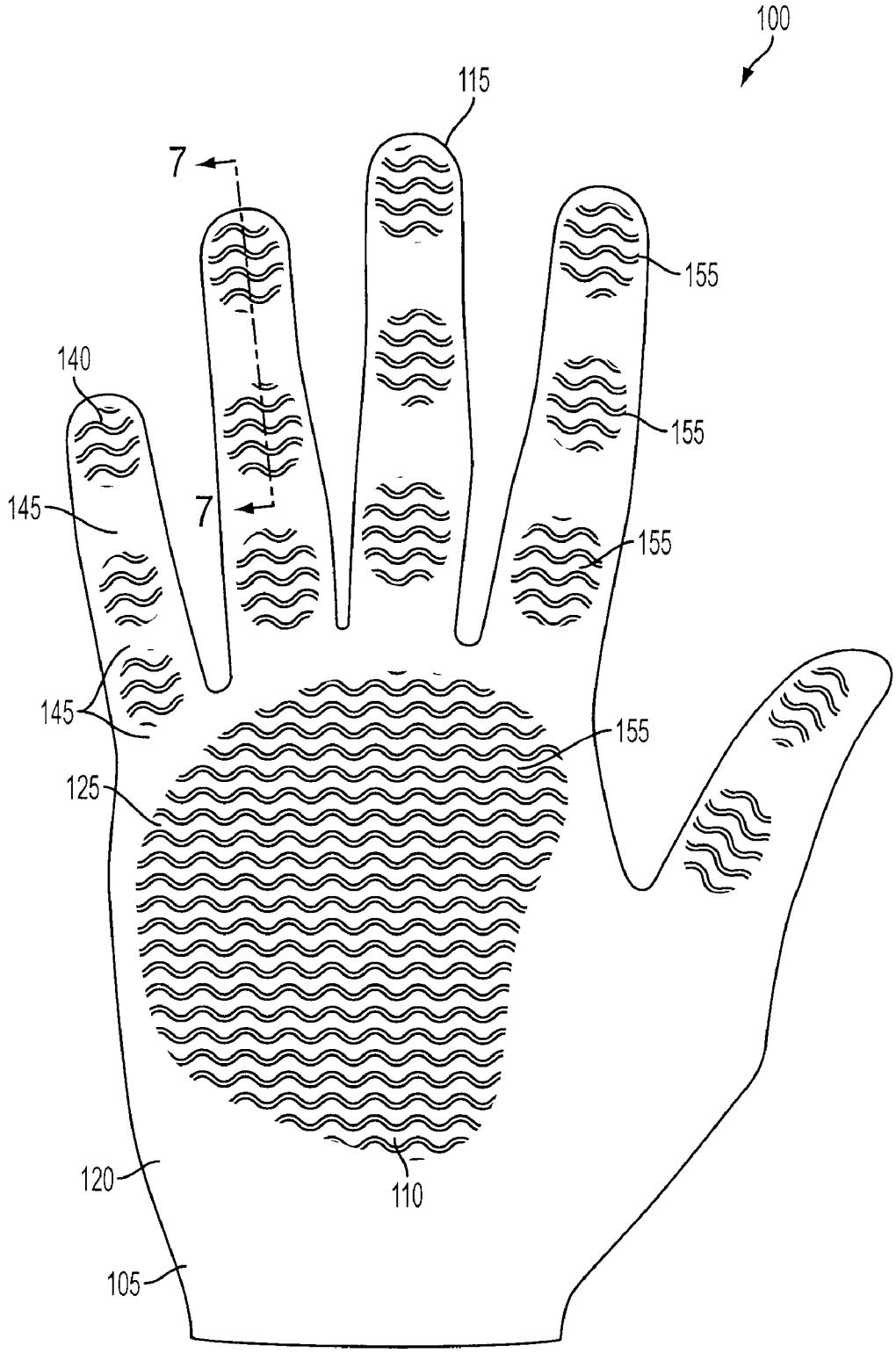
FIG. 1A illustrates a palm side of a glove according to at least one aspect of the disclosure.
Figure 1B:
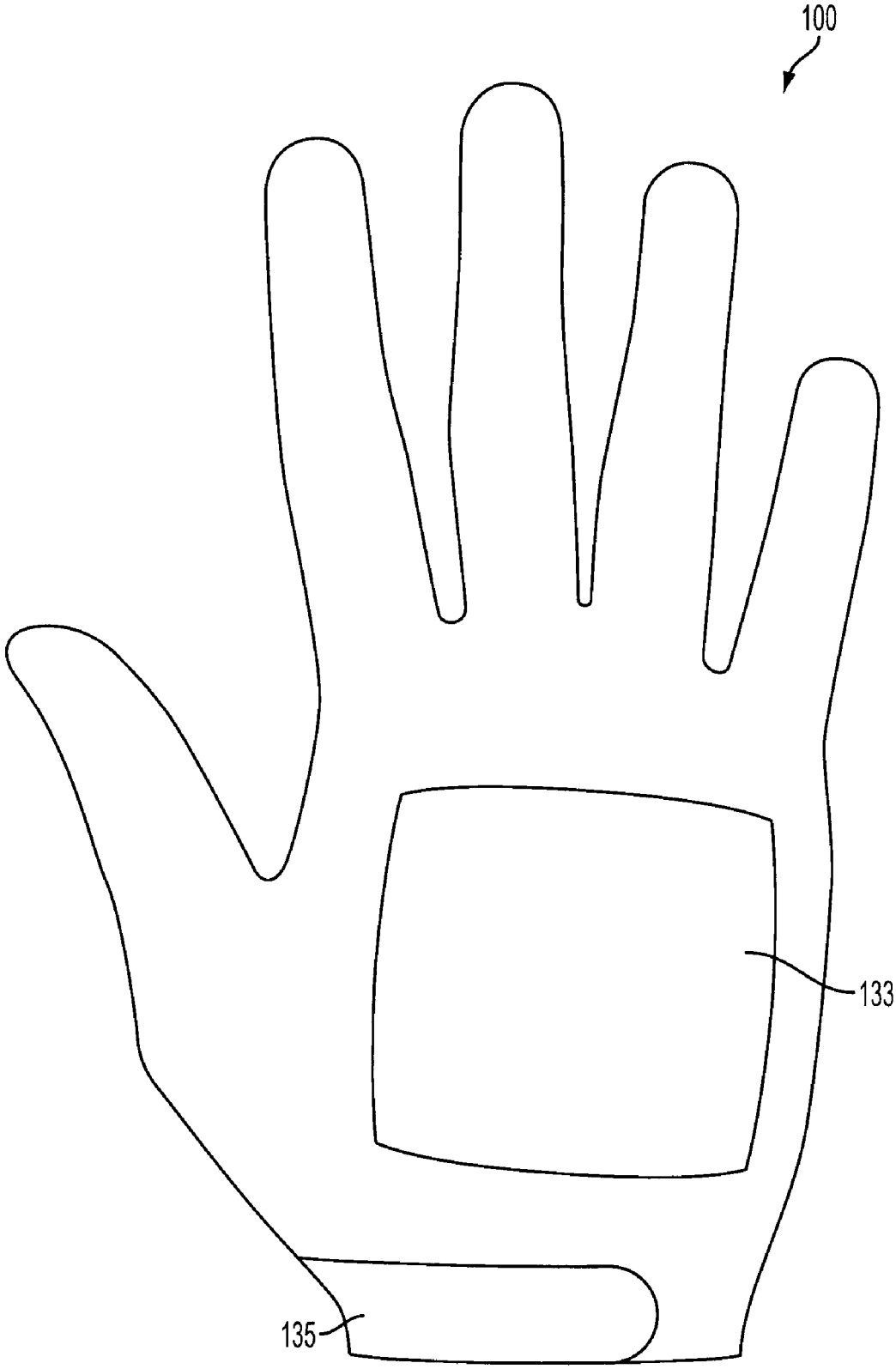
FIG. 1B illustrates a back side of the glove depicted in FIG. 1A.

An illustrative embodiment of a glove according to one aspect of the disclosure is shown at FIGS. 1A and 1B. In FIG. 1A, the palm side of the glove 100 is shown while in FIG. 1B the back side of the glove is shown. As shown in the FIG. 1A, the palm side of the glove 100 may include a palm-side portion 105 which extends substantially over the face of the palm side of the glove. The palm-side portion 105 includes the palm area 110 and the inner sides of the fingers stalls 115 and the thumb stall.

In contrast to the shallow, printed texture of the silicone printed surfaces of conventional gloves, the glove according to aspects of the present disclosure provide a deeper and more crisply defined texture (more "three dimensional [3-D]" compared to the "two dimensional [2-D]" structure of conventional printed gloves). An initial benefit of the "3-D" gloves is that the texture will last longer than the shallow printed texture of the "2-D" gloves because there is simply more material, and therefore, the material will not be quickly rubbed away thorough the abrasions resulting from contact with objects to be gripped (e.g. catching a football.)

In accordance with at least some aspects of this disclosure, the construction of such gloves may include multiple materials. For example, in the embodiment shown in FIG. 1A, the majority of the glove (e.g. a base layer 120) may be constructed from a single flexible material such as textiles, hydrophilic textiles, fabric, leather, synthetic leather, etc. In another embodiment, the glove may be constructed from a plurality of joined flexible parts. In the embodiment shown in FIG. 1A, the glove's palm side and back side would be constructed of such material, and, in fact, could be constructed as a single unitary piece, although this is not necessary. A second layer 125 with a contact surface 130 may be disposed on top of the base layer 120 at the palm side portion 105 of the glove. This second layer 125 may be formed either integrally with or alternatively adhered to the base layer 120 in a known manner. The second layer 125 may be comprised of a material such as thermoplastics (e.g. polyurethane), thermoset plastics (e.g. silicone), other plastics, Polyvinyl Chloride (PVC), rubber, synthetic rubber, leather, synthetic leather, TPU, elastomers, or other polymeric materials, e.g., of the types used in bladders for balls, footwear soles, and the like. The second layer 125 may enhance the gripping ability of the glove.

In at least some example structures in accordance with this invention, the second layer 125 may have a height or thickness, up to the contact surface 130 of up to 12 mm, and in some more specific examples, this height may be in the range of 0.1 to 10 mm, 0.75 to 8 mm, or even 1-6 mm thick. Therefore, as described above the material will not be quickly rubbed away thorough the abrasions resulting from contact with objects to be gripped (e.g. catching a football.)

Further, the above described embodiment may include other materials. For example, the back side of the glove 100 may include one or more patches 133 of LYCRA® or other breathable material which allows the skin to "breathe" and, in addition, allow moisture to be wicked away from the hand. Because the hand is encased in the glove 100, the temperature may be increased and therefore perspiration may occur. This is especially true if the glove 100 is being worn during athletic activities. Therefore, it may be beneficial, at least in some conditions of use, to allow the hand to breathe or for moisture to be wicked away by including the one or more patches 133 of material such as LYCRA®, or alternatively, by creating the entire back side of the glove 100, from a material such as LYCRA®, etc. Providing a stretchable material for use as the back of the glove (or at least portions thereof) also may help provide a tight but customizable or adjustable fit.

The glove 100 may include an adjustable strap 135 near an opening for inserting and removing the hand from the glove. The strap may be used for tightening and loosening the glove 100 around the hand. Further, the strap may include known means such as snaps, buttons, VELCRO®, elastic bands, etc. to attach to the glove 100. Any desired size adjustment and/or glove securing mechanisms may be provided, if desired, without departing from this invention.

According to one aspect of the disclosure, the second layer 125 may be constructed so that it includes (1) a series of 'siping' grooves 140 and (2) a series of channels 145. The 'siping' grooves 140 and the channels 145 enhance the gripping ability of the gloves by: (a) directing liquid (e.g. water) away from contact areas 155 of the second layer 125, (b) creating additional voids and edges in the second layer 125, (c) increasing the surface area of the second layer 125, (d) allowing less inhibited movement of the hand, (e) increasing the "feel" of the glove 100, and (f) creating multiple biting edges that mechanically interlock with other rough surfaces such as the pebble grain of a football.

Siping Grooves

The siping grooves 140 remove liquid (e.g. water) from the contact surface 130 of the glove 100. In one embodiment, capillary action of the siping grooves 140 may suck the liquid off the contact surface 130 of the second layer 125 and conduct it into the depth of siping groove 140 and/or to the channels 145. Therefore, the contact surface 130 is kept substantially dry, even when exposed to wet conditions. A dry contact surface 130 is desirable because it provides better friction and grip. Therefore, removing liquid from the contact surface 130 would be extremely beneficial in increasing a wearer's gripping ability.

Further, the siping grooves 140 can direct the collected liquid through the siping grooves 140 to the sides of the glove and/or to the channels 145. The siping grooves according to at least some example structures according to this invention 140 accomplish removal of the liquid from the contact areas 155, because the grooves 140 are substantially continuous along their length. Further, the grooves 140 may be formed in patterns so that the ends of the substantially continuous grooves 140 are directed toward the sides of the gloves. Therefore, these patterns remove the liquid (e.g. water) from the contact areas 155 by directing the liquid to the sides of the glove. There, the liquid merely drips off the sides of the glove. Hence, these groove patterns prevent the liquid from accumulating at the contact areas 155 of the glove 100, thereby increasing the friction characteristics of the glove 100.

As shown in FIG. 1A, one pattern in which the siping grooves 140 may be formed is a series of sinusoidal waves or lines. These sinusoidal waves are inherently curved and may extend across all, substantially all, or merely a portion of the palm-side portion 105 of the glove. Therefore, liquid would be directed through the curved sinusoidal siping grooves 140 to the sides of the glove. The waves may be oriented in any direction. For example, the direction of the curves may be laterally across the palm-side portion 105 (as shown in FIG. 1A) or alternatively they may be oriented vertically along the palm side portion 105 or further alternatively at an angle askew to the lateral and vertical directions. The waves also may be arranged to curve somewhat as they extend along the glove (i.e., the central axis of the sine wave forming the grooves need not be a perfectly straight line).

The amount of friction associated with a particular orientation of the sinusoidal siping grooves 140 may be considered in determining the direction of the siping grooves 140. For example, the friction of the sinusoidal siping grooves 140 may be more effective in a lateral direction as opposed to a vertical direction or at a particular askew angle. The dimensions of the siping grooves 140, such as the width, can be varied depending on desired purposes (for example, the efficiency of the discharge of water to the sides of the glove). However, the second layer 125 should still have an adequate amount of contact surface 130 to grip the object. The siping grooves 140 also may be arranged in different directions in selected portions of an individual glove, e.g. different orientations on the fingers v. the thumb v. the palm, for example, to maximize grip and contact and/or the presence of biting edges at different areas of the hand, optionally based on typical contact directions with the ball or other object at that area of the hand.

Figure 2:
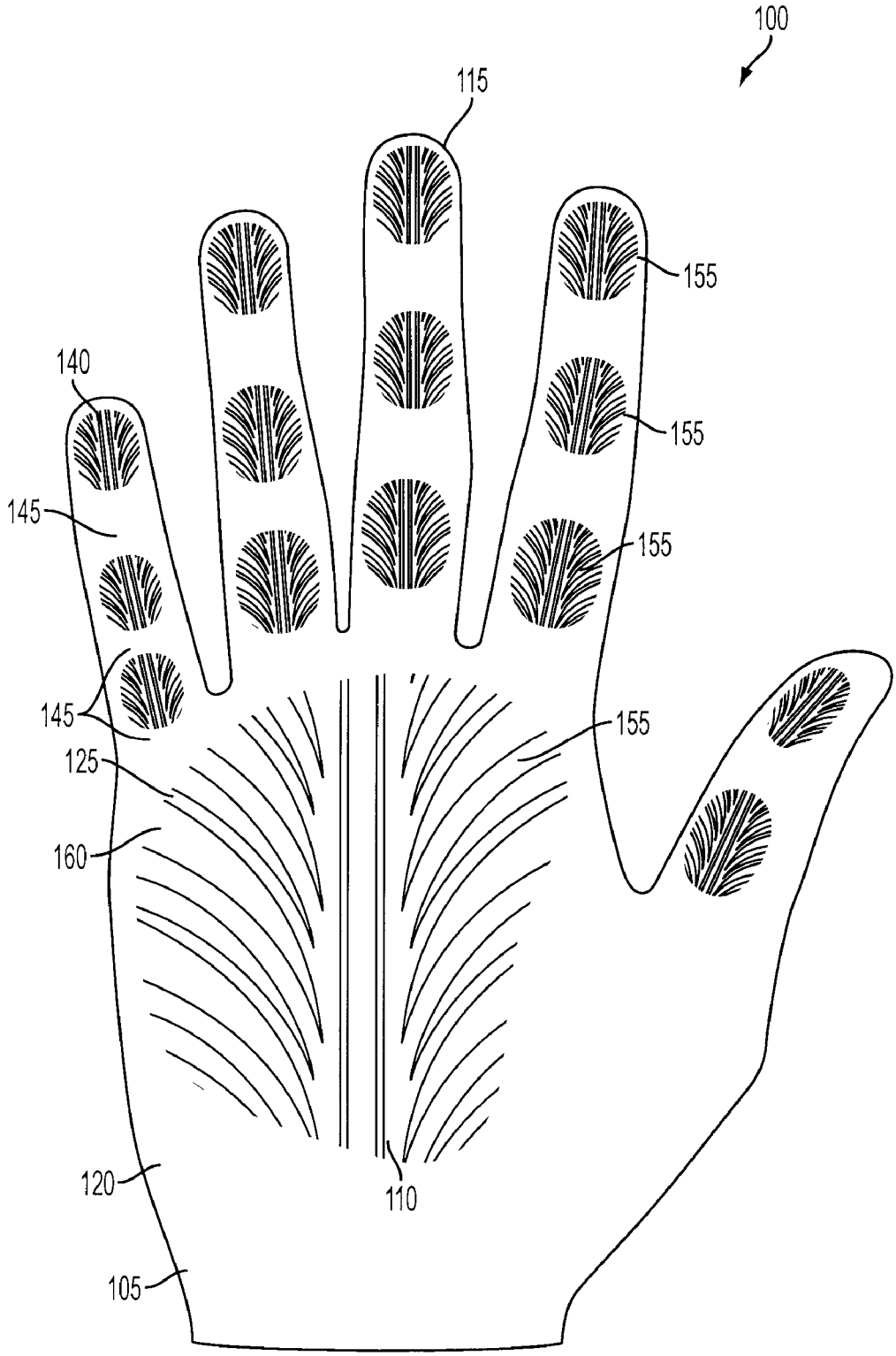
FIG. 2 illustrates a palm side of a glove according to a second aspect of the disclosure.

FIG. 2 illustrates another pattern in which the grooves 140 are formed in a pattern wherein the siping grooves 140 comprise rows or columns and slanted or curved lines. The siping grooves 140 may form generally "V" or "U" shapes which move liquid away from the contact area to the sides of the glove where the liquid would merely drip off. Also, the pattern includes siping grooves 140 in the shape of rows or columns which may conduct water to the sides of the gloves including a wrist portion or the finger tips of the glove. The pattern may include siping grooves 140 of differing widths. The dimensions of the siping grooves 140, such as the width, can be varied depending on desired purposes (for example, the efficiency of the discharge of water to the sides of the glove). However, the second layer 125 should still have an adequate amount of contact surface 130 to grip the object. The pattern may be oriented in any direction. For example, the direction of the pattern may be laterally across the palm-side portion 105 or alternatively oriented vertically along the palm side portion 105 or further alternatively at an angle askew to the lateral and vertical direction. The amount of friction associated with a particular orientation of the pattern may be considered in determining the direction of the siping grooves 140. For example, the friction of the pattern may be more effective in a lateral direction as opposed to a vertical direction or at a particular askew angle.

Figure 3:
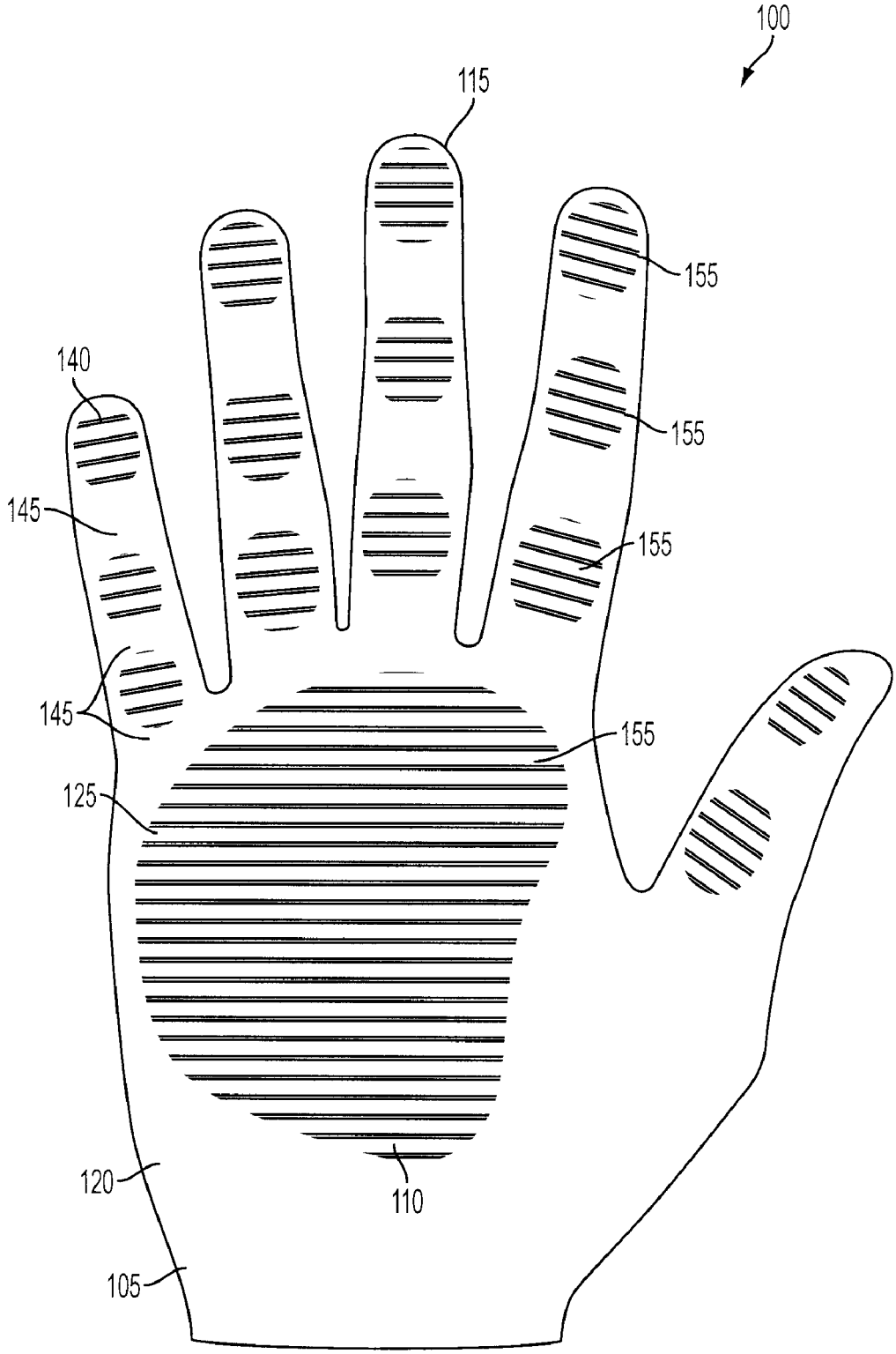
FIG. 3 illustrates a palm side of a glove according to a third aspect of the disclosure.
Figure 4:
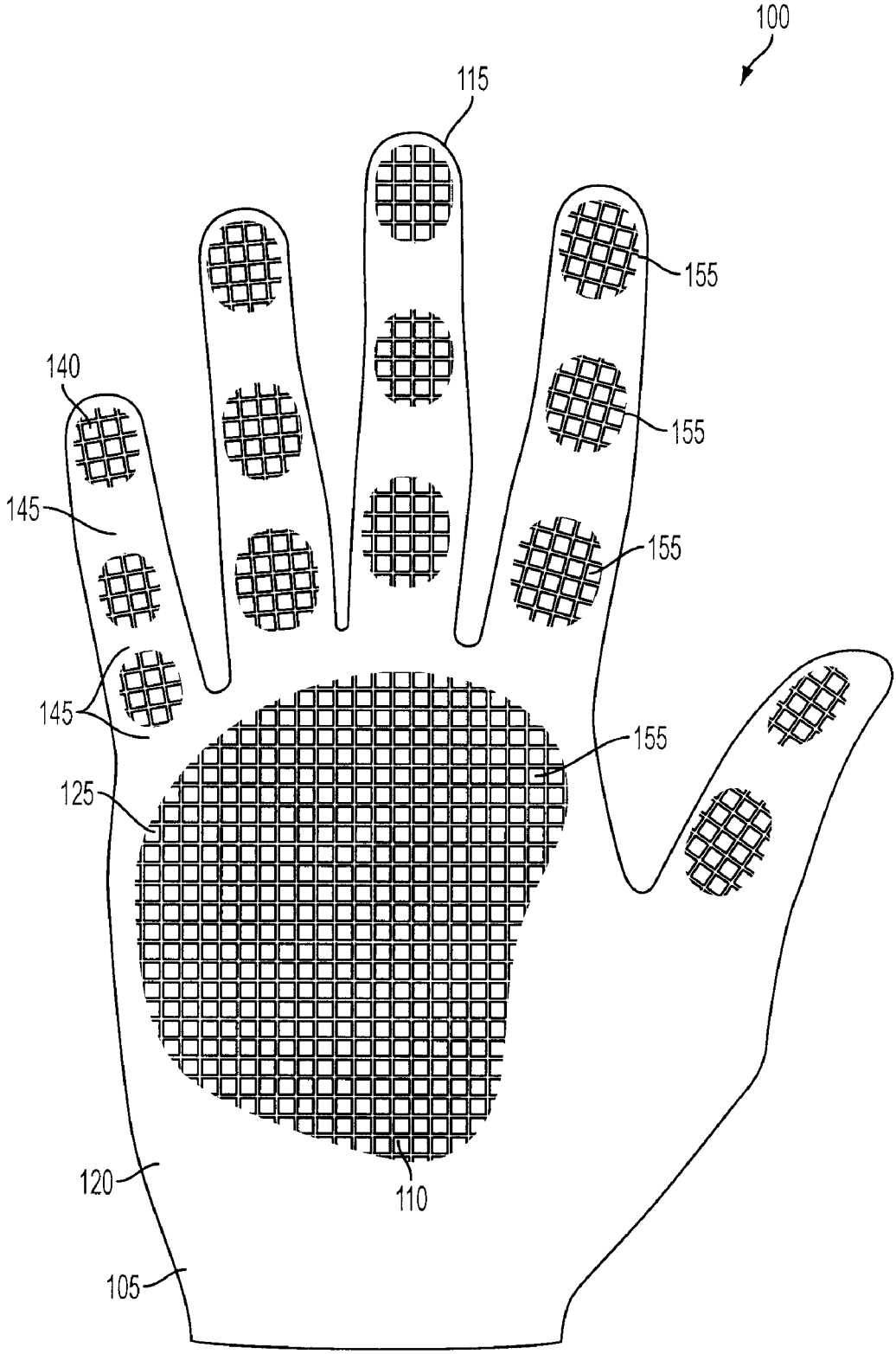
FIG. 4 illustrates a palm side of a glove according to a fourth aspect of the disclosure.
Figure 5A:
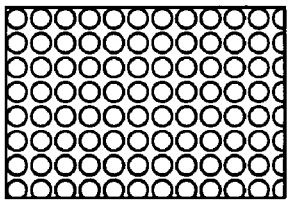
FIGS. 5A-G illustrates swatches of various other patterns according to this disclosure.
Figure 5B:
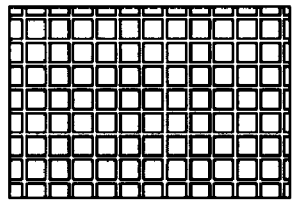
Figure 5C:
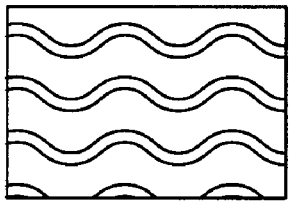
Figure 5D:
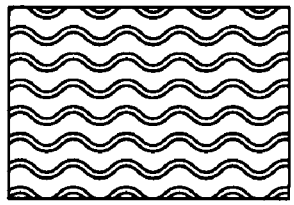
Figure 5E:
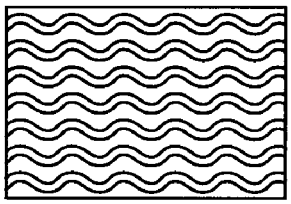
Figure 5F:
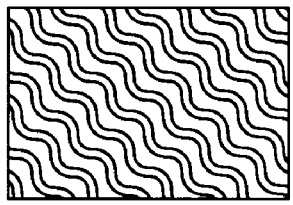
Figure 5G:
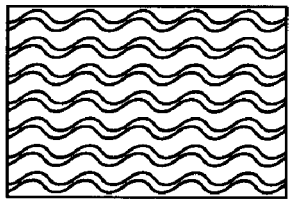

Other patterns of the siping grooves 140 may include straight lines as shown in FIG. 3 or grid-like structures as shown in FIG. 4. Additional patterns are shown in FIGS. 5A-G. Further, these patterns may be combined or mixed depending on particular end uses of the glove. Also, many other patterns are possible including linear, non-linear, directional, non-directional, "squiggles," dots, geometric shapes, organic shapes, or the like. Further, the contact surface to siping groove area ratios that create more and less raised surface area, may be implemented so that either the contact surface 130 is greater than the groove area or, conversely, the groove area (negative space) is greater than the contact area 130. The grip pattern of FIG. 5A provides certain advantages because of the round structure of the raised areas (which provides liquid wicking channel areas between the raised round portions). The round structure of the raised areas provides good gripping action in all directions because raised edges are provided in every direction, irrespective of the direction of ball (or other object) contact. The raised round portions may be of any desired height without departing from this invention, including up to 12 mm high, and in some more specific examples, this height may be in the range of 0.1 to 10 mm, 0.75 to 8 mm, or even 1-6 mm. While any desired spacing between raised round portions also may be used without departing from this invention, preferably the edge of one raised portion will be spaced from the edges of the other raised portions by less than 8 mm, and in some more specific examples, these edge spacings may be spaced less than 6 mm, or even less than 4 mm or 2 mm. The round raised areas of FIG. 5A (as well as the various other patterns described herein) may be spaced around a glove structure, for example, in the manner generally illustrated in FIG. 1A or in at least some of the areas illustrated in FIG. 1A.

Figure 6A:
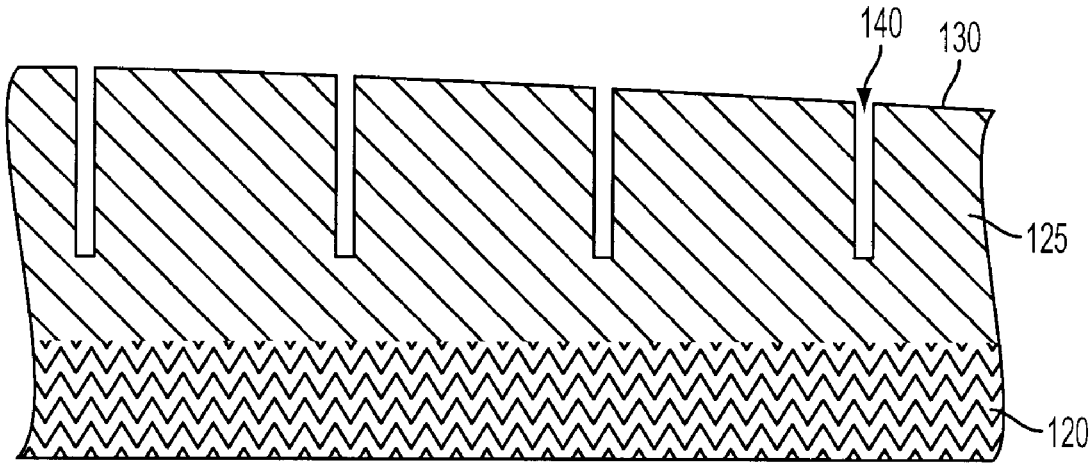
FIG. 6A illustrates an enlarged cross-sectional view of a portion of a glove according to one aspect of this disclosure.

As stated above, the dimensions of the siping grooves 140 may vary based on the desired purpose. For example, in order to collect more water, in some embodiments, the siping grooves 140 may be wider. In other embodiments, the siping grooves 140 may be narrower or slimmer, and in fact, in some embodiments, the siping grooves 140 may be almost microscopic. The depth of the siping grooves 140 is also variable. As described above, the siping grooves 140 are disposed in the second layer 125. In one embodiment, shown in FIG. 6A, the siping groove 140 does not extend all the way through the second layer 125 to meet the base layer 120. Therefore, as shown in FIG. 6A, the siping groove is entirely within the second layer 125. In an alternative embodiment, shown in FIG. 6B, the depth of the siping grooves 140 is greater and extends all the way through the second layer 125 to the base layer 120. In this embodiment, the base layer 120 becomes the bottom of the siping groove. In this embodiment, the materials from which both the base layer 120 and the siping groove 140 are constructed can affect the siping grooves 140 ability to collect water. For example, hydrophobic or hydrophilic materials may be used singularly or in combination. The combination may create a push-pull system where water is repelled from the contact surface 130 and attracted into and out of the siping grooves 140. The depths of the siping grooves may be varied within the grooves provided in a single glove structure.

Figure 6B:
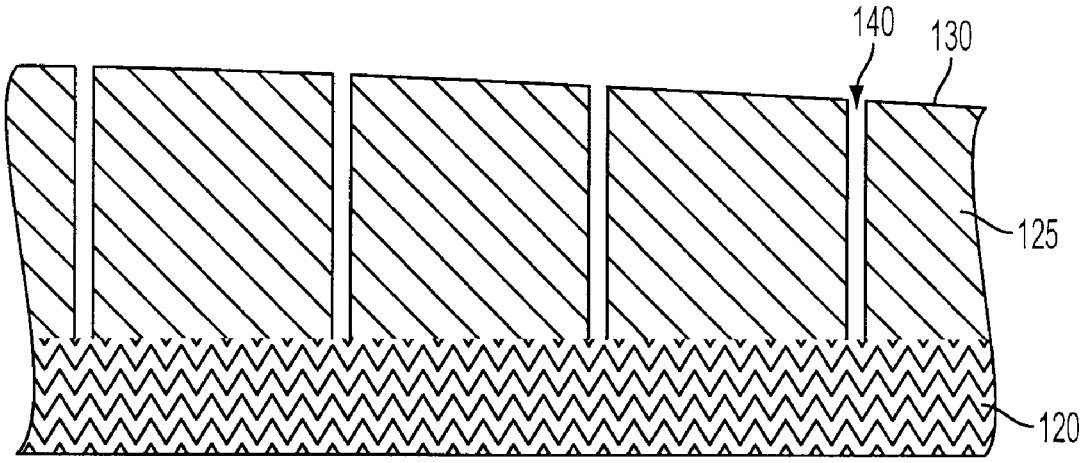
FIG. 6B illustrates an enlarged cross-sectional view of a portion of a glove according to another aspect of this disclosure.

As shown in the example structures of FIGS. 6A and 6B, the siping grooves 140 may be made deeper (into layer 125) than they are wide (across surface 130), and they may have a depth in at least some structures in accordance with this invention in the range of up to 12 mm, and in some more specific examples, in the range of 0.1 to 10 mm, 0.75 to 8 mm, or even 1-6 mm deep. The width of the grooves 140, in at least some example structures according to this invention, may be up to 8 mm, and in some more specific example structures, up to 6 mm, up to 4 mm, or even up to 2 mm wide.

In addition to removing liquid away from the contact surface 130 and contact areas 155 of the glove, the siping grooves 140 also increase the friction of the palm-side portion 105 by creating more voids and edges in the second layer 125. These additional edges can engage or "grab" more areas of the object to be gripped. Therefore, the additional edges and voids of the siping grooves 140 generally enhance the friction of the contact surface 130 compared to gloves that have a flat surface (i.e. a surface devoid of grooves 140, edges, etc.).

In addition to the siping grooves 140, the contact areas 155 may also contain grooves 160. As seen in FIG. 2, the contact area 155 located in the palm area 110 has several grooves 160. These grooves 160 direct liquid away from the contact areas 155 of the glove toward the sides of the glove just as the siping grooves 140 do, but the grooves 160 can direct a larger quantity of liquid. Therefore, by directing larger amounts of liquid from the contact area, the contact area remains drier. As seen in FIG. 2, the grooves 160 may resemble the same patterns as the siping grooves 140, however this is not necessary.

Channels

Figure 7:
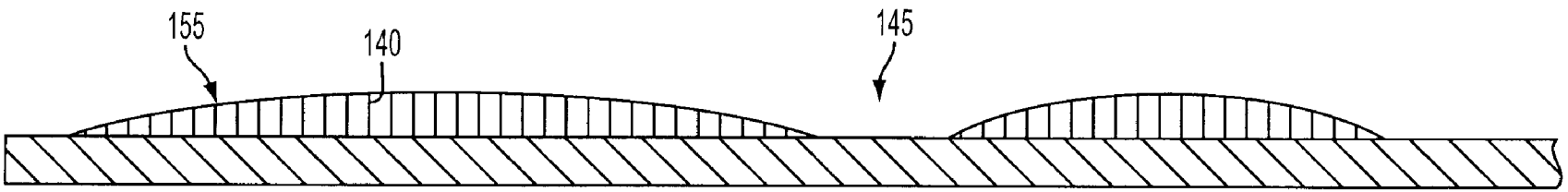
FIG. 7 illustrates an enlarged cross-sectional view of a portion of a glove according to another aspect of this disclosure.

In the above described embodiments, the second layer 125 may be disposed on the base layer 120 at the palm-side portion 105 so that contact areas are raised areas, or lugs, and further, are created at different locations of the palm side. In some embodiments, the second layer 125 may be disposed on the base layer 120 in a discontinuous manner. One discontinuous manner may be a plurality of "islands" wherein the second layer may have raised contact areas 155 spaced apart from each other in particular patterns. For example, as seen in FIG. 1A, the second layer's raised contact areas 155 may be provided at a palm area 110 and at the inner sides of the finger stalls 115 (including the thumb) while areas between the raised contact areas 155 are not covered by the second layer 125. Inherently, this discontinuous positioning of the raised contact areas 155 on the base layer 120 will define areas of less height between said the various raised portions. For example, the particular positioning of the raised contact areas 155 in FIG. 1A defines areas of less height (i.e. channels 145) at the knuckle areas of the palm-side portion 105. The depth of the channels 145 between the raised contact areas 155 will depend on the heights of the raised contact areas 155 which define them. As seen in the cross sectional view of FIG. 7, the raised contact areas 155 may include gentle increasing and decreasing slopes along its area. Further, as seen in the cross sectional view of FIG. 7, ends of two raised contact areas 155 slope toward each other to provide the boundary or sides of the channel 145. However, the raised contact areas 155 may have other forms also. For example, the raised contact areas 155 may have a rectangular cross-section instead of the curved slope shown in FIG. 7. Therefore, the raised contact areas 155 would define a rectangular channel 145. The raised contact areas 155 may have other forms as well without departing from the scope of the invention.

The channels 145 provide several benefits. First, the channels 145 may transport large quantities of water away from the palm-side portion 105 of the glove. As can be seen in the cross-sectional view of FIG. 7, the slopes of the raised contact areas 155 will direct water toward the channels 145. Similarly, the rectangular cross section would allow water to be collected into the channel 145. Therefore, water that comes into contact with the raised contact areas 155 will be immediately directed toward the channels 145 and/or down into the siping grooves 140. Then, the water collected in the channels 145 will be directed toward the sides of the glove. Thereby, the channels 145 prevent water accumulating at the raised contact areas 155 of the palm-side portion 105. In this way, the channels 145 and the siping grooves 140 provide a "two-fold" system for directing water away from both the raised contact areas 155 of the palm-side portion 105 and the contact surface 130.

Further, the dimensions of the channels 145 may be large enough to not only remove the water, but also to direct foreign matter, such as sand, mud, grass, etc., away from the palm-side portion 105.

A second benefit of the combination of the raised contact areas 155 and channels 145 is that they create additional voids and edges for contacting the object to be gripped. While the additional voids and edges created by the raised contact areas 155 and channels 145 are on a larger scale than the voids and edges created by the siping grooves 140, they serve the same purpose. In other words, the additional edges can engage or "grab" more areas of the object to be gripped while the additional voids create different levels of surfaces which also improves the friction characteristics of the glove 100. Therefore, the raised contact areas 155 and channels 145 create additional friction to the palm-side surface 105.

Another benefit of the combination of raised contact areas 155 and channels 145 is that the total surface area of the glove is increased. The additional surface area provides more friction which adds additional grip to the glove. Further, the greater surface area helps the viscoelastic nature of the second layer to have more time to deflect over a greater area and thus to act to decelerate fast moving objects (i.e., catching a pass, receiving a snap, etc.).

An additional benefit of the combination of raised contact areas 155 and channels 145 is that movement of the hand is less inhibited. In other words, the raised contact areas 155 and the channels 145 allow the glove to bend or flex more readily with the movement of the hand (e.g. curling of the fingers). While disposing a second layer 125 on base layer 120 provides additional gripping ability, the additional thickness can detract from the flexibility of the glove. In general, the thicker the object becomes, the more resistant to bending the object becomes. Therefore, providing a relatively thick second layer 125 across the entire palm-side portion 105 would hinder the ability of the glove to flex or bend. However, by providing the raised contact areas 155 at particular contact portions and providing the channels 145 at particular bending portions, the thickness of the second layer 125 will have a reduced and/or minimal effect on the flexing or bending capabilities of the glove. This arrangement of raised contact areas 155 and channels 145 allows the individual elements of the hand to move independently in the X, Y and Z axes because they are decoupled. For example, as seen in FIG. 1A, the raised portions may be provided at the finger stalls 115 and the palm area 110 while the channels 145 are provided at the knuckle areas and/or other bendable areas of the palm portion. In this arrangement, the gripping ability of the glove is enhanced while not substantially detracting from the gloves ability to flex or bend.

Yet another benefit of the combination of raised contact areas 155 and channels 145 is that the feel of the glove is enhanced compared to a glove having a thicker surface across the entire palm-side portion 105 of the glove. In general, thick/stiff materials are not desirable in athletic gloves because they act to moderate pressure over a large area, which reduces the ability of the touch receptors to give information about the touch and grip to the athlete's nervous system. The channels 145 of this glove allow the glove to include the thicker raised portions where they are most beneficial (e.g. at particular contact areas like the finger stalls or palm), while limiting the amount of the thickness at other areas of the glove. The thinness of the glove at these other areas allows it to articulate, stretch and compress with the movement of the hand. Further, pressure in the hand (e.g., palm) would be felt in small discrete areas giving better tactile sensitivity than a thick stiff material. Overall, the glove will have a better "feel" as compared with a glove with thicker second layer 125 over the entire palm-side portion 105.

Gloves according to particular aspects of this disclosure may be created by typical forming processes such as injection or compression molding. However such processes may or may not yield the fine detail required for aspects of the glove. Water jet cutting and chemical etching are alternative possible methods of manufacture (e.g., for forming the siping or other grooved areas). Laser cutting also may give a high level of sharpness and fine detail to the siping channels and/or other edges, and while all the above methods are applicable, laser cutting is a preferred method of manufacture.

CONCLUSION

In conclusion, the glove described in the above disclosure provides several benefits to the wearer. It enhances the gripping ability of the wearer by creating additional voids and edges in the second layer 125. Further, it increases the surface area of the second layer 125 to provide additional friction and improve catching ability. Also, the glove prevents the hand from being inhibited in its movement. Additionally, the "feel" of the glove is increased. Further, the "siping" grooves 140 and the channels 145 act to retain the enhanced gripping capability of the glove by providing a "two-fold" system for moving water away from the contact areas 155 and the contact surface 130. Therefore, this "two-fold" system retains the already enhanced gripping ability of the glove even when the glove is used in wet conditions.

While the disclosure has been described with respect to specific examples including presently preferred modes of carrying out the disclosure, those skilled in the art will appreciate that there are numerous variations and permutations of the above described structures and methods. Thus, the spirit and scope of the disclosure should be construed broadly as set forth in the appended claims.

For example, it is noted that while disclosed views show the raised contact areas as being discontinuous, this is not required. For example, the second layer may be continuous across some or all of the palm side portion and the raised contact areas simply extend upward from this higher starting elevation. For example, the second layer may include a very thin layer which continuously covers the palm-side portion, and therefore the raised contact areas extend upward from that level, as opposed to the base layer.

Alternatively, the glove may be constructed so that the palm side of the glove may be made from a single material, such as an elastomeric material, while the back side of the glove is made from a single, different material, such as fabric, leather etc. The palm side and the back side may then be attached or adhered to each other in any known fashion such as stitching, etc. In this embodiment, the elastomeric material may be the only material of the palm side portion. Therefore, the elastomeric material would have both the siping grooves and the channels formed in the second layer. For example, the channels would merely be a thinned portion of elastomeric material while the raised contact areas would be merely a thicker portion. As yet additional examples, if desired, the second layer may be omitted and the siping (and other) grooves may be formed directly in the palm side glove material and/or the raised material forming the raised edges may be fixed to the palm side glove material (e.g. by adhesives, stitching, etc.) to thereby form the siping channels and/or other grooves.

Additionally, while described in detail in terms of use for football or soccer, those skilled in the art will appreciate that aspects of this invention may be used in a wide variety of athletic and other activities, including any activities in which gloves are worn, grip can be important, and/or damp or wet conditions may be experienced, such as golf, baseball, softball, hockey, rowing, tennis, gardening, fire-fighting, etc.

I claim:

1. A glove comprising:

a base layer of a flexible material which extends along at least a palm-side portion of the glove, wherein the base layer includes a palm area and inner sides of a plurality of finger stalls and a thumb stall;

a second layer positioned on the palm-side portion and disposed on the base layer, wherein the second layer defines:

a plurality of contact areas, wherein each contact area has a center and a peripheral edge; and a contact surface;

a plurality of siping grooves defined in the contact surface, wherein the siping grooves conduct liquid away from the contact surface; and a plurality of channels defined between portions of the second layer, wherein the channels direct liquid away from the contact areas, wherein the contact areas of the second layer are raised and each contact area exhibits a curved sloped cross section that varies in thickness across its respective area such that the contact area is convex and slopes such that the center of the contact area has a greater thickness than the peripheral edge of the contact area, wherein the contact surface is the top of the raised contact areas, wherein a width of each of the channels is greater than a width of the siping grooves.

2. The glove according to claim 1, wherein the second layer is disposed on the base layer in a discontinuous manner so as to define the plurality of channels between the raised contact areas.

3. The glove according to claim 2, wherein the raised contact areas are positioned at the finger stalls, thumb stall and palm area and the channels are positioned at knuckle areas along the finger stalls including where the finger stalls meet the palm area.

4. The glove according to claim 1, wherein the siping grooves are disposed in the second layer and a capillary action of the siping grooves draws liquid off the contact surface of the second layer and conducts the liquid into the depth of the siping groove.

5. The glove according to claim 4, wherein the siping grooves extend to the base layer so that the base layer is the bottom of the siping groove and the base layer is at least partially made of a hydrophilic material and the contact surface at least partially includes a hydrophobic material.

6. The glove according to claim 4, wherein the siping grooves include walls that extend substantially continuously from a first end of the siping groove to a second end of the siping groove, further wherein the second layer includes a pattern in which the substantially continuous siping grooves are disposed to transport liquid away from the contact areas to sides of the glove.

7. The glove according to claim 6, wherein the pattern is a pattern which positions the substantially continuous siping grooves as at least a first series of substantially continuous siping grooves extending along the palm-side portion, and at least a second and a third series of substantially continuous siping grooves adjacent the first series of substantially continuous siping grooves and extending in opposite directions from each other.

8. The glove according to claim 6, wherein the pattern is a grid including straight-line substantially continuous siping grooves extending throughout the palm-side portion, wherein said grid forms rectangular portions.

9. The glove according to claim 4, wherein the second layer is at least as thick as the base layer.

10. The glove according to claim 4, wherein the second layer is made from an elastomeric material and further wherein there is more contact surface than groove area.

11. The glove according to claim 4, wherein the second layer includes a pattern in which the substantially continuous siping grooves are disposed to transport liquid away from the contact areas to sides of the glove, and further wherein, in addition to the siping grooves, the pattern also includes grooves which direct liquid away from the rest of the contact area.

12. A glove comprising:

a base layer of a flexible material which extends along at least a palm-side portion of the glove, wherein the base layer includes a palm area and inner sides of a plurality of finger stalls and a thumb stall;

a second layer positioned on the palm-side portion and disposed on the base layer, wherein the second layer defines a plurality of contact areas and a contact surface;

a plurality of siping grooves defined in the contact surface, wherein the siping grooves conduct liquid away from the contact surface; and a plurality of channels defined between portions of the second layer, wherein the channels direct liquid away from the contact areas, wherein the contact areas of the second layer are raised and each contact area varies in thickness across its respective area and further wherein the contact surface is the top of the raised contact areas, wherein the siping grooves are disposed in the second layer and a capillary action of the siping grooves draws liquid off the contact surface of the second layer and conducts the liquid into the depth of the siping groove, wherein the siping grooves include walls that extend substantially continuously from a first end of the siping groove to a second end of the siping groove, wherein the second layer includes a pattern in which the substantially continuous siping grooves are disposed to transport liquid away from the contact areas to sides of the glove, wherein the pattern is a pattern which positions the substantially continuous siping grooves as at least a first series of substantially continuous siping grooves extending along the palm-side portion, and at least a second and a third series of substantially continuous siping grooves adjacent the first series of substantially continuous siping grooves and extending in opposite directions from each other, wherein the second and third series of substantially continuous siping grooves curve away from each other toward opposite sides of the palm-side portion of the glove.

13. The glove according to claim 12, wherein each of the second and third series of substantially continuous siping grooves has grooves of differing widths.

14. A glove comprising:

a base layer of a flexible material which extends along at least a palm-side portion of the glove, wherein the base layer includes a palm area and inner sides of a plurality of finger stalls and a thumb stall;

a second layer positioned on the palm-side portion and disposed on the base layer, wherein the second layer defines a plurality of contact areas and a contact surface;

a plurality of siping grooves defined in the contact surface, wherein the siping grooves conduct liquid away from the contact surface; and a plurality of channels defined between portions of the second layer, wherein the channels direct liquid away from the contact areas, wherein the contact areas of the second layer are raised and each contact area varies in thickness across its respective area and further wherein the contact surface is the top of the raised contact areas, wherein the siping grooves are disposed in the second layer and a capillary action of the siping grooves draws liquid off the contact surface of the second layer and conducts the liquid into the depth of the siping groove, wherein the siping grooves include walls that extend substantially continuously from a first end of the siping groove to a second end of the siping groove, further wherein the second layer includes a pattern in which the substantially continuous siping grooves are disposed to transport liquid away from the contact areas to sides of the glove, wherein the pattern positions the substantially continuous siping grooves as a series of substantially sinusoidal lines extending toward the sides of the glove.

15. A glove comprising:

a first exterior surface at a first level of a palm side of the glove;

a second exterior surface at a second level of a palm side of the glove wherein the second level is above said first level;

a plurality of grooves in said second exterior surface wherein said grooves remove liquid from the second exterior surface; and a plurality of discontinuous raised areas defining a plurality of channels along the first exterior surface between the plurality of discontinuous raised areas wherein said channels are disposed at knuckle areas between raised areas, wherein each of the raised areas has a center and a peripheral edge;

wherein each of the raised areas exhibits a curved sloped cross section that varies in thickness across its respective area such that the raised area is convex and slopes such that the center of the raised area has a greater thickness than the peripheral edge of the raised area.

16. The glove according to claim 15, wherein the grooves include walls that extend substantially continuously from a first end of the groove to a second end of the groove, and further wherein the glove includes a pattern in which the substantially continuous grooves are disposed to transport liquid away from the contact areas to sides of the glove.

17. The glove according to claim 16, wherein the pattern is a pattern which positions the substantially continuous grooves as at least a first series of substantially continuous grooves extending along the palm-side portion, and at least a second and a third series of substantially continuous grooves adjacent the first series of substantially continuous grooves and extending in opposite directions from each other.

18. A glove comprising:

a palm-side portion including a base layer;

a grip enhancing discontinuous layer disposed on the palm-side portion of the glove;

wherein the discontinuous layer includes raised contact areas positioned at a plurality of finger stalls, a thumb stall and a palm area and the raised contact areas define a series of channels at knuckle areas which interrupt the discontinuous layer, a plurality of grooves defined in said discontinuous layer wherein said grooves remove liquid from the surface of the discontinuous layer; and further wherein the channels remove liquid from the raised contact areas, wherein each of the raised contact areas has a center and a peripheral edge;

wherein each of the raised contact areas exhibits a curved sloped cross section that varies in thickness across its respective area such that raised contact area is convex and slopes such that the center of the raised contact area has a greater thickness than the peripheral edge of the raised contact area, wherein a width of each of the channels is greater than a width of the grooves.

19. The glove according to claim 18, wherein the grooves are disposed in the discontinuous layer and a capillary action of the grooves draws liquid off the discontinuous layer and conducts the liquid into the grooves.

20. The glove according to claim 19, wherein the grooves extend to the base layer so that the base layer is the bottom of the groove and the base layer is at least partially made of a hydrophilic material and the discontinuous layer at least partially includes a hydrophobic material.

* * * * *